United States Patent [19]

Shushlebin et al.

[11] 4,363,658

[45] Dec. 14, 1982

[54] PROCESS FOR COMBINED PRODUCTION OF METAL ALLOYS AND ZIRCONIUM CORUNDUM

[76] Inventors: Boris A. Shushlebin, Sirenevy bulvar. 27, korpus 3, kv. 53; Nikolai A. Bogdanov, Dnepropetrovskaya ulitsa, 19, korpus 2, kv. 130, both of, Moscow; Viktor V. Tregubenko, ulitsa Zavodskaya, 6, kv. 2, Krasnogorsk Moskovskoi oblasti; Nikolai I. Subbotin, ulitsa Klubnaya, 9, kv. 3; Mikhail V. Galkin, ulitsa Klubnaya, 4, kv. 1, both of Sysertsky raion, poselok Dvurechensk, all of U.S.S.R.

[21] Appl. No.: 232,931

[22] Filed: Feb. 9, 1981

Related U.S. Application Data

[63] Continuation of Ser. No. 82,208, Oct. 5, 1979, abandoned.

[51] Int. Cl.[3] ..... C22B 34/00

[52] U.S. Cl. ..... 75/84; 75/93 A; 420/590; 420/422

[58] Field of Search ..... 75/84, 134 S, 93 A, 75/135, 177

[56] References Cited

U.S. PATENT DOCUMENTS

| | | | |
|---|---|---|---|
| 1,503,772 | 8/1924 | Smith | 75/134 S |
| 2,955,933 | 10/1960 | Freeman | 75/134 S |
| 3,272,623 | 9/1966 | Grafts et al. | 75/134 S |
| 4,018,597 | 4/1977 | Staggers | 75/134 S |
| 4,036,641 | 7/1977 | Evans | 75/134 S |
| 4,080,194 | 3/1978 | Fey . | |
| 4,229,214 | 10/1980 | Shushlelun et al. | 75/135 |

FOREIGN PATENT DOCUMENTS 608845 5/1978 U.S.S.R. .

*Primary Examiner*—Herbert T. Carter
*Attorney, Agent, or Firm*—Ladas & Parry

[57] ABSTRACT

A process for combined production of metal alloys, containing zirconium, iron, silicon and aluminium, and of a zirconium corundum, which method comprises melting charge materials, such as a zirconium concentrate, an iron ore and aluminium taken in a weight ratio of 51-69: 9.9-16.5: 19.8-34.8, respectively, at a temperature of 1,950° to 2,000° C., and a separate pouring of end products, the zirconium corundum being poured first. The remaining metal alloy is melted, prior to pouring, with fluxes taken in amounts of 5 to 35% by weight of the zircon concentrate and with charge materials, such as ferrosilicon, taken in an amount of 3 to 102% by weight of silicon of the total weight of the zircon concentrate, ferrosilicon, ferromanganese or metallic manganese taken in an amount of 3 to 26% by weight of manganese of the total weight of the zircon concentrate, at a temperature ranging from 1,950° to 2,000° C. Ferrosilicotitanium, ferrotitanium or metallic titanium in an amount of 4 to 41% by weight of titanium of the total weight of the zircon concentrate may be introduced into the metal alloy. The above method yields metal alloys suitable for treating cast iron with a view of preventing chilling of thin-walled parts of castings and for enhancing the mechanical strength of cast iron castings.

2 Claims, No Drawings

PROCESS FOR COMBINED PRODUCTION OF METAL ALLOYS AND ZIRCONIUM CORUNDUM

This is a continuation, of application Ser. No. 082,208 filed Oct. 5, 1979, now abandoned.

BACKGROUND OF THE INVENTION

1. Field of the Invention

The invention relates to ferrous metallurgy and more particularly to a process for combined production of metal alloys, containing zirconium, iron silicon and aluminium, and of a zirconium corundum.

Such metal alloys are used for deoxidizing and alloying steels, irons and alloys for various applications, whereas the zirconium corundum is employed in the manufacture of abrasive tools for grinding steel ingots and billets prior to rolling.

2. Description of the Prior Art

There is known a process for combined production of metal alloy, such as ferrosilicozirconium, consisting of zirconium, iron, silicon and aluminium, and of a zirconium corundum, comprising melting charge materials, such as a zirconium concentrate, iron ore and aluminium taken in proportion by weight of 51-69:9.9-16.5:19.8-34.8, respectively, at a temperature within the range of 1,950° to 2,000° C. and a separate pouring of end products, it being preferable to initially pour the zirconium corundum, then the metal alloy/cf.U.S.S.R. Inventor's Certificate No. 608,845, Biulleten izobretenyi i otkrytii SSSR n. 20, 1978/.

The known method permits combined production of a metallic alloy (ferrosilicozirconium) and a zirconium corundum using a simple process procedure. However, the metal alloy thus obtained cannot be employed for alloying cast irons with the aim of preventing chilling thereof during casting of thin-walled parts.

SUMMARY OF THE INVENTION

It is an object of the invention to provide a process for combined production of metal alloys containing zirconium, iron, silicon and aluminium and of zirconium corundum which would make it possible to obtain metal alloys suitable for alloying cast iron with a view of preventing chilling thereof during casting of thin-walled parts.

The above and other objects of the invention are attained in process for combined production of metal alloys containing zirconium, iron, silicon and aluminium and of a zirconium corundum by melting burden materials, such as a zirconium concentrate, an iron ore and aluminium taken in proportions by weight of 51-69:9.9-16.5:19.8-34.8, respectively, at a temperature of 1,950° to 2,000° C., and by pouring separately end products, first, the zirconium corundum, then the metal alloy, in the process, according to the invention, fluxes taken in an amount of 5 to 35% by weight of the total weight of zirconium concentrate and charge materials, such as ferrosilicon in an amount of 3 to 102% by weight of silicon of the total weight of the zirconium concentrate and ferrosilicomanganese, ferromanganese or metallic manganese in an amount of 3 to 26% by weight of manganese of the total weight of the zirconium concentrate are introduced into the metal alloy and melted at a temperature ranging from 1,950° to 2,000° C.

The resultant metal alloy containing also manganese along with zirconium, iron, silicon and aluminium is suitable for alloying cast iron with a view of preventing chilling thereof during casting of thin-walled parts.

In order to eliminate the chilling of cast irons during casting and improve mechanical strength of iron castings, it is preferable to add ferrosilicotitanium ferrotitanium or metallic titanium in an amount of 4 to 41% by weight of titanium of the total weight of the zirconium concentrate to the metallic alloy along with the fluxes and said charge materials prior to the melting thereof. The melting yields a metal alloy also containing titanium along with zirconium, iron, silicon and aluminium. The presence of titanium in the metal alloy enhances mechanical strength of iron castings. For example, a mould of iron alloyed with the metal alloy of the above composition features a service life of up to 115 days, no cracks or cavities being observed in the mould during said period; a mould of iron not alloyed with said metal alloy has a service life under the same conditions by a factor of 2 to 4 less than the mould from the alloyed cast iron, the plain cast iron mould failing because of the formation therein of cracks and cavities.

The process of the invention makes it possible to produce metal alloys and zirconium corundum according to a simple production technique. Zirconium is completely recovered from the zirconium concentrate to yield end products. The combined production of the end products substantially brings down the cost of said products as compared to their separate manufacture. The quality of the products obtained in accordance with is equal to that in their separate manufactures. For example, the resultant metal alloys have a melting point ranging from 1,230° to 1,380° C. this providing their ready solubility in steels, cast irons and alloys for various applications during their deoxidation and alloying. In addition, the metal alloys can readily be crushed to required size. Zirconium corundum obtained by the above method features high abrasive properties.

The process of the invention makes it possible to eliminate the formation in the course of melting of waste zirconium-bearing slags which find no industrial application.

DETAILED DESCRIPTION

The process according to the invention for joint manufacture of metallic alloys and zirconium corundum is carried out into effect in the manner below.

Charge materials, such as zircon concentrate, iron ore and aluminium (preferably as powder) in proportions by weight of 51-69:9.9-16.5:19.8-34.8, respectively, are charged into a melting apparatus, for example, an arc furnace. The charge materials are melted at a temperature within the range of 1,950° and 2,000° C. to obtain a metal alloy consisting of zirconium, iron, silicon and aluminium and a zirconium corundum. The zirconium corundum is poured from the arc furnace, for example, into heavy metallic with air or liquid cooling, whereas fluxes, such as calcium oxide, magnesium oxide, calcium fluoride in an amount of 5 to 35% by weight of the zirconium concentrate and additional charge materials, such as ferrosilicon, taken in an amount of 3 to 102% by weight of silicon of the total weight of the zirconium concentrate and ferrosilicomanganese, ferromanganese or metallic manganese in an amount of 3 to 26% by weight of manganese of the total weight of the zirconium concentrate are added to the remaining metal alloy and melted at a temperature within the range of 1,950° and 2,000° C. As a result, there is obtained a metal alloy consisting of zirconium, iron, silicon, aluminium and manganese and a waste slag free from zirconium, the metal alloy and the waste slag being poured separately from the arc furnace into metallic moulds and cooled.

In addition, the process of the invention provides a possibility for a joint manufacture of a metal alloy consisting of zirconium, iron, silicon, aluminium, manganese and titanium and a zirconium corundum. To this end, charge materials, such as zirconium concentrate, iron ore and aluminium, are charged in specified proportions by weight into a melting apparatus, for example, an arc furnace. The charge materials are melted at a temperature between 1,950° and 2,000° C. to yield a metal alloy consisting of zirconium, iron, silicon and aluminium, and a zirconium corundum. The latter is poured from the arc furnace, whereas fluxes taken in an amount of 5 to 35% by weight of the zirconium concentrate and charge materials, such as ferrosilicon, taken in an amount of 3 to 102% by weight of silicon of the total weight of the zirconium concentrate, ferrosilicomanganese, ferromanganese or metallic manganese taken in an amount of 3 to 26% by weight of manganese of the total weight of the zirconium concentrate, ferrosilicotitanium ferrotitanium or metallic titanium taken in an amount of 4 to 41% by weight of titanium of the total weight of the zircon concentrate are added to the remaining metal alloy and melted at a temperature ranging from 1,950° to 2,000° C., said process yielding a metal alloy consisting of zirconium, iron, silicon, aluminium, manganese and titanium and a waste slag, free from zirconium, the metal alloy of the above composition and said waste slag being poured separately from the arc furnace into metal moulds and cooled.

The invention will be further described by the following illustrative Examples.

EXAMPLE 1

An arc furnace is charged with 2400 kg of zirconium concentrate containing 65% by weight of zirconium dioxide and 32% of silicon dioxide, 480 kg of iron ore containing 96% by weight of iron oxide and 840 kg of aluminium powder containing 90% by weight of aluminium. The proportions by weight of said charge materials are 64.5:12.9:22.6, respectively. The charge materials are melted at the temperature of 2,000° C. for 3.5 hours to obtain 1,100 kg of a metallic alloy consisting of 40.7% by weight of zirconium, 27% by weight of iron, 29.4% by weight of silicon, 1.1% by weight of aluminium, 1.8% by weight of associated impurities (copper, carbon and others), and 2,400 kg of a zirconium corundum consisting of 39.3% by weight of zirconium dioxide, 54.3% by weight of aluminium oxide, 2.0% by weight of silicon dioxide, 0.8% by weight of calcium oxide, 2.1% by weight of magnesium oxide, 1.5% by weight of total iron (i.e., metallic iron and ferrous oxide. Zirconium corundum is poured from the arc furnace into heavy metal moulds and cooled in the air. The arc furnace holding the remaining metal alloy is then charged with 120 kg of lime (flux) containing 96% by weight of calcium oxide, 1,600 kg ferrosilicon containing 75% by weight of silicon and 24% by weight of iron, and 332 kg metallic manganese containing 94% by weight of manganese. Said additives are melted at the temperature of 2,000° C. for 2 h to yield 2,990 kg of a metallic alloy consisting of 14.9% by weight of zirconium, 22.7% by weight of iron, 50.8% by weight of silicon, 0.4% by weight of aluminium, 10.4% by weight of manganese, 0.8% by weight of associated impurities (copper, carbon and others) and 110 kg of a waste slag free from zirconium. The metallic alloy and the waste slag are poured separately.

The resultant metal alloy of the above composition was employed to alloy a gray iron. Casting of thin-walled parts from said alloyed gray iron involved no chilling whatsoever.

The resultnat zirconium corundum was employed to manufacture abrasive tools for grinding steel ingots and billets prior to rolling.

EXAMPLE 2

An arc furnace is charged with 2,400 kg of zirconium concentrate, 635 kg of iron ore and 1,620 kg of aluminium powder, the proportions by weight of said burden components being 51.6:13.6:34.8, respectively. The charge is melted at the temperature of 1,960° C. for 3.6 h to yield 1680 kg of a metal alloy consisting of 48% by weight of zirconium, 22.1% by weight of iron, 19.2% by weight of silicon, 9.5% by weight of aluminium, 1.2% by weight of associated impurities (copper, carbon and others) and 2,600 kg of zirconium corundum consisting of 17.5% by weight of zirconium dioxide, 76.9% by weight of aluminium oxide, 1.1% by weight of silicon dioxide, 1% by weight of calcium oxide, 2.7% by weight of magnesium oxide, 0.8% by weight of total iron. The zirconium corundum is poured from the arc furnace into heavy metallic moulds and cooled. The arc furnace with the remaining metal alloy is charged with 160 kg of fluxes (80 kg of calcium oxide and 80 kg of magnesium oxide), 1900 kg of ferrosilicon containing 75% by weight of silicon and 24% by weight of iron and 380 kg of ferrosilicomanganese containing 68.5% by weight of manganese, 28.5% by weight of silicon and 1.4% by weight of iron. Said additives are melted at the temperature of 1,950° C. for 2.6 h to obtain 3,920 kg of a metal alloy consisting of 20.6% by weight of zirconium, 21% by weight of iron, 47.3% by weight of silicon, 4% by weight of aluminium, 6.6% by weight of manganese, 0.5% of associated impurities and 150 kg of a waste slag free from zirconium. The metal alloy and the waste slag are poured separately.

EXAMPLE 3

An arc furnace is charged with 2,000 kg of zirconium concentrate, 400 kg of iron ore and 1,000 kg of an aluminium powder. Ratio by weight of said burden materials is 58.8:11.8:29.4 respectively. The charge is melted at the temperature of 1980° C. for 2.6 h to yield 1,160 kg of a metallic alloy consisting of 43.2% by weight of zirconium, 20.9% by weight of iron, 27.3% by weight of silicon, 6.2% by weight of aluminium, 2.4% by weight of associated impurities and 2,240 kg of zirconium corundum composed of 27.3% by weight of zirconium dioxide, 68.5% by weight of aluminium oxide, 1.4% by weight of silicon dioxide, 0.7% by weight of calcium oxide, 0.9% by weight of magnesium oxide and 1.2% by weight of total iron. Zirconium corundum is poured into heavy metal moulds and cooled in the air. The arc furnace with the remaining metal alloy is then charged with 700 kg of calcium fluoride, 2,210 kg of ferrosilicon containing 75% by weight of silicon and 24% by weight of iron and 213 kg of ferromanganese containing 87% by weight of manganese, 2% by weight of silicon and 10% by weight of iron. Said additives are melted at the temperature of 2,000° C. for 2.5 h, and 3,364 kg of a metallic alloy consisting of 14.9% by weight of zirconium, 26.4% weight of iron, 50.5% by weight of silicon, 2.1% by weight of aluminium, 5% by weight of manganese, 1.1% by weight of associated impurities, and 620 kg of a waste slag free from zirconium are obtained. The metal alloy and the waste slag are poured separately.

EXAMPLE 4

An arc furnace is charged with 1,600 kg of zirconium concentrate, 252.8 kg of iron ore and 539.2 kg of aluminium powder. The ratio by weight of said burden materials is 66.9:10.6:22.5 respectively. The charged burden materials are melted at the temperature of 2,000° C. for 2.1 h to produce 600 kg of metallic alloy consisting of 35.9% by weight of zirconium, 25.4% by weight of iron, 35.3% by weight of silicon, 0.8% by weight of aluminium, 2.6% by weight of associated impurities and 1,790 kg of a zirconium corundum consisting of 43.5% by weight of zirconium dioxide, 51.5% by weight of aluminium oxide, 2.2% by weight of silicon dioxide, 1.2% by weight of calcium oxide, 0.6% by weight magnesium oxide and 1% by weight of total iron. The zirconium corundum is poured into heavy metallic moulds and cooled in the air. The metallic alloy remaining in the arc furnace is then melted at the temperature of 2,000° C. for 2.2 h with the addition of 320 kg of lime containing 96% by weight of calcium oxide, 1,768 kg of ferrosilicon containing 75% by weight of silicon and 24% by weight of iron and 568 kg of ferrosilicomanganese containing 68.5% by weight of manganese, 28.5% by weight of silicon and 1.4% by weight of iron. Melting results in 2,726 kg of a metal alloy consisting of 7.9% by weight of zirconium, 22.2% by weight of iron, 55.7% by weight of silicon, 0.3% by weight of aluminium, 12.9% by weight of manganese, 1% by weight of associated impurities and 302 kg of a waste slag free from zirconium. The metal alloy and the waste slag are poured separately.

EXAMPLE 5

An arc furnace is charged with 2,400 kg of a zirconium concentrate containing 65% by weight of zirconium dioxide and 32% by weight of silicon dioxide, 571 kg of iron ore, containing 96% of iron oxide and 1,464 kg of aluminium powder containing 90% by weight of aluminium. The ratio by weight of said burden materials is 54.1:12.9:33, respectively. The charge is melted at the temperature of 1,960° C. for 3.4 h to yield 1,760 kg of a metal alloy consisting of 45.8% by weight of zirconium, 19.5% by weight of iron, 23.4% by weight of silicon, 9% by weight of aluminium, 2.3% by weight of associated impurities and 2,670 kg of a zirconium corundum consisting of 16.9% by weight of zirconium dioxide, 78.9% by weight of aluminium oxide, 1.1% by weight of silicon dioxide, 0.7% by weight of calcium oxide, 1% by weight of magnesium oxide an 1.4% by weight of total iron. The zirconium corundum is poured into heavy metal moulds and cooled in the air. The remaining metal alloy is then melted in the arc furnace together with 360 kg of calcium oxide, 778 kg of ferrosilicon containing 75% by weight of silicon and 24% by weight of iron and 254 kg of metallic manganese containing 94% by weight of manganese for 1.1 h at the temperature of 2,000° C. Said melting results in 2,652 kg of a metal alloy consisting of a metal alloy consisting of 30.5% by weight of zirconium, 24% by weight of iron, 30.8% by weight of silicon, 5.3% by weight of aluminium, 8.1% by weight of manganese, 1.3% by weight of associated impurities and 312 kg of a waste slag free from zirconium. The metal alloy and the waste slag are poured separately.

EXAMPLE 6

An arc furnace is charged with 2,400 kg of zirconium concentrate, 343.2 of iron ore and 732 kg of aluminium powder. The ratio by weight of said charge components is 69:9.9:21.1 respectively. The charge is melted at the temperature of 2,000° C. for 3.3 h to produce 820 kg of a metal alloy consisting of 34.9% by weight zirconium, 25.1% by weight of iron, 36.8% by weight of silicon, 0.7% by weight of aluminium, 2.5% by weight of associated impurities and 2,650 kg of a zirconium corundum consisting of 46.2% by weight of zirconium dioxide, 48.8% by weight of aluminium oxide, 2.3% by weight of silicon dioxide, 1.1% by weight of calcium oxide, 0.7% by weight of magnesium oxide and 0.9% by weight of total iron. The zirconium corundum is poured into heavy metal moulds and cooled in the air. The metal alloy remaining in the arc furnace is melted together with 240 kg of fluxes (120 kg of clacium oxide and 120 kg of magnesium oxide), 100 kg of ferrosilicon containing 75% by weight of silicon and 24% by weight of iron, 90 kg of metallic manganese containing 89% by weight of manganese and 624 kg of ferrosilicotitanium containing 30% by weight titanium, 20% by weight of silicon, 35% by weight of iron and 10% by weight of aluminium. The additives are melted at the temperature of 2,000° C. for 0.9 h, the process resulting in 1,623 kg of a metal alloy consisting of 17.7% by weight of zirconium, 32.8% by weight of iron, 29.9% by weight of silicon, 4.2% by weight of aluminium, 4.4% by weight manganese, 9.7% by weight of titanium, 1.3% by weight of associated impurities and 202 kg of waste slag free from zirconium. The metal alloy and the waste slag are poured separately.

The metal alloy of said chemical composition was used to alloy gray iron. The chemical composition of the gray iron was as follows (% by weight): carbon, 3.65; silicon, 2.4: manganese, 1.1; sulfur, 0.12; iron, the balance. Said metal alloy was added in an amount of 0.8% by weight of molten iron, and the alloying resulted in a cast iron of the following chemical composition (% by weight): carbon, 3.62; silicon, 2.62; manganese, 1.13; sulfur, 0.08; titanium, 0.08; zirconium, 0.12; iron, the balance. The alloyed iron was employed to cast an iron mould which contained no chilled iron. The mould from the alloyed cast iron had a service life of 91 days, neither cracks nor cavities observed in the mould during the period. A mould from plain iron had a service life under the same conditions of 27 days, cracks and cavities having occurred.

EXAMPLE 7

An arc furnace is charged with 2,400 kg of zirconium concentrate, 517.2 kg of iron ore and 732 kg of an aluminium powder. The ratio by weight of said burden materials is 64.8:15.4:19.8, respectively. The charge is melted at the temperature of 2,000° C. for 3.3 h to yield 868 kg of a metal alloy consisting of 23.9% by weight of zirconium, 39.7% by weight of iron, 33.4% by weight of silicon, 0.6% by weight of aluminium, 2.4% by weight of associated impurities and 2,892 of a zirconium corundum consisting of 48.1% by weight of zirconium dioxide, 46.2% by weight of aluminium oxide, 2.4% by weight of silicon dioxide, 0.9% by weight of calcium oxide, 1% by weight of magnesium oxide and 1.4% by weight of total iron. The zirconium corundum is poured into heavy metal moulds and cooled in the air. The metal alloy remaining in the arc furnace is melted together with 240 kg of calcium oxide, 510 kg of ferrosilicon containing 75% by weight of silicon and 24% by weight of iron, 248 kg of ferromanganese containing 87% by weight of manganese, 2.5% by weight of silicon, 10% by weight of iron and 334 kg of ferrotitanium, containing 32% by weight of titanium, 10% by weight of silicon, 46% by weight of iron and 10% by weight of aluminium. The additives are melted at the temperature of 2,000° C. for 1.1 h to produce 1,939 kg of a metal alloy consisting of 10.8% by weight of zirconium, 35.3% of iron, 36% by weight of silicon, 2% by weight of aluminium, 10.1% by weight of manganese, 4.7% by weight of titanium, 1.1% of associated impurities, and 205 kg of a waste slag free from zirconium. The metal alloy and the waste slag are poured separately.

The resultant metal alloy was used to alloy a gray iron of a chemical composition given in the Example 6. Said metal alloy was employed in an amount of 1% by weight of molten iron. Alloying yielded a cast iron of the following chemical composition (% by weight): carbon, 3.61; silicon, 2.73; manganese, 0.19; sulfur, 0.08; titanium, 0.05; zirconium, 0.09; iron, the balance. A metal mould was cast from the alloyed iron, and no chilling occurred. The metal mould from the alloyed iron has a service life of 115 days, and no cracks and cavities were observed in the metal mould. A mould of non-alloyed iron has a service life under the same conditions of 27 days and fails through formation of cracks and cavities.

EXAMPLE 8

An arc furnace is charged with 1,600 kg of zircon concentrate, 420.8 kg of iron ore and 539.2 kg of aluminium powder. The ratio by weight of said burden materials is 62.5:16.4:21.1 respectively. The charge is melted at the temperature of 2,000° C. for 2.1 h, and the result is 650 kg of a metallic alloy consisting of 28% by weight of zirconium, 39% by weight of iron, 30.3% by weight of silicon, 0.6% by weight of aluminium, 2.1% by weight of associated impurities and 1,900 kg of a zirconium corundum consisting of 44.5% by weight of zirconium dioxide, 50.3% by weight of aluminium oxide, 2.2% by weight of silicon dioxide, 0.8% by weight of calcium oxide, 1.2% by weight of magnesium oxide and 1% by weight of total iron. The zirconium corundum is poured into heavy metallic moulds and cooled in the air. The metallic alloy remaining in the arc furnace is further melted with the addition of 560 kg of calcium fluoride, 2,165 kg of ferrosilicon containing 75% by weight of silicon and 24% by weight of iron, 550 kg of ferrosilicomanganese containing 73.8% by weight of manganese, 18.6% by weight of silicon and 5.3% by weight of iron and 704 kg of metallic titanium containing 92% by weight of titanium at the temperature of 2,000° C. for 3.5 h. The result is 3,888 kg of a metal alloy consisting of 4.9% of zirconium, 24.1% by weight of iron, 47.% by weight of silicon, 0.1% by weight of aluminium, 9.4% by weight of manganese, 14.1% by weight of titanium, 0.4% by weight of associated impurities, and 490 kg of a waste slag free from zirconium. The metal alloy and the waste slag are poured separately.

EXAMPLE 9

A zirconium concentrate, an iron ore and an aluminium powder are melted in an arc furnace under the same conditions and at the same ratio as in Example 7. A zirconium corundum is cast into heavy metal moulds and cooled. The arc furnace with the remaining metal alloy is charged with 120 kg of lime containing 96% by weight of calcium oxide, 500 kg of ferrosilicon containing 75% by weight of silicon and 24% by weight of iron, 650 kg of ferrosilicomanganese containing 73.8% by weight of manganese, 18.6% by weight of silicon and 5.3% by weight of iron and 520 kg of a metallic titanium containing 92% by weight of titanium. The additives are melted at the temperature of 2,000° C. for 1.8 h to yield 2,400 kg of a metal alloy consisting of 8.6% of zirconium, 19.6% by weight of iron, 32.7% by weight of silicon, 0.2% by weight of aluminium, 19.9% by weight of manganese, 18.1% by weight of titanium, 0.9% by weight of associated impurities, and 110 kg of a waste slag free from zirconium. The metal alloy and the waste slag are poured separately.

What is claimed is:

1. A process for combined production of a metal alloy containing zirconium, iron, silicon and aluminum and of zirconium corundum, comprising melting in a furnace a mixture of a zircon concentrate, an iron ore and aluminum taken in a ratio by weight of 51-69:9.9-16.5:19.8-34.8, respectively, at a temperature within the range of 1,950° to 2,000° C. to form a metal alloy consisting of Zr, Fe, Si and Al and a zirconium corundum, pouring the zirconium corundum from the furnace adding to the remaining alloy fluxes taken in an amount of 5 to 35 of the weight of the zircon concentrate and ferrosilicon taken in an amount of 3 to 102% by weight of silicon of the total weight of the zirconium concentrate and a substance selected from among ferrosilicomanganese, ferromanganese and metallic manganese taken in an amount of 3 to 26% by weight of manganese of the total weight of the zirconium concentrate, melting at a temperature of 1,950° to 2,000° C. to produce the metal alloy consisting of Zr, Fe, Si, Al and Mn and a waste slag substantially free of Zr and pouring the metal alloy and slag separately from the furnace.

2. A process as claimed in claim 1 where a substance selected from among ferrosilicotitanium, ferrotitanium and metallic titanium taken in an amount of 4 to 41% by weight of titanium of the total weight of the zirconium concentrate is also added to said remaining alloy.

* * * * *